US008347537B2

(12) United States Patent
Huang

(10) Patent No.: US 8,347,537 B2
(45) Date of Patent: Jan. 8, 2013

(54) LABEL TAG CORD

(76) Inventor: Ying-Che Huang, Taipei (TW)

( * ) Notice: Subject to any disclaimer, the term of this patent is extended or adjusted under 35 U.S.C. 154(b) by 77 days.

(21) Appl. No.: 12/962,857

(22) Filed: Dec. 8, 2010

(65) Prior Publication Data

US 2011/0072695 A1 Mar. 31, 2011

Related U.S. Application Data

(63) Continuation-in-part of application No. 12/410,907, filed on Mar. 25, 2009, now abandoned.

(51) Int. Cl.
*A44C 5/00* (2006.01)

(52) U.S. Cl. ..... 40/633; 206/343; 24/704.1; 24/711.1

(58) Field of Classification Search ..... 24/704.1, 24/711.1; 452/198; 40/662; 206/495, 493, 206/231, 338, 343
See application file for complete search history.

(56) References Cited

U.S. PATENT DOCUMENTS 1,213,903 A * 1/1917 Powell ..... 24/711.1
2,586,978 A * 2/1952 Murray ..... 428/67
3,020,657 A * 2/1962 Clark ..... 40/633
3,444,597 A * 5/1969 Bone ..... 24/711.1
3,508,303 A * 4/1970 Miyasaka ..... 24/298
3,611,514 A * 10/1971 De Wit ..... 24/704.1
3,686,717 A * 8/1972 Merser ..... 24/298
3,850,297 A * 11/1974 Merser ..... 206/343
3,968,582 A * 7/1976 Jones ..... 40/27.5
4,417,656 A * 11/1983 Kato ..... 206/346
5,018,286 A * 5/1991 Zahner ..... 40/665
5,046,221 A * 9/1991 Walker ..... 24/66.2
5,246,757 A * 9/1993 Condon et al. ..... 428/40.9
5,311,689 A * 5/1994 Lindsey ..... 40/633
5,321,872 A * 6/1994 Merser ..... 24/704.1
5,546,688 A * 8/1996 Merser ..... 40/663
5,553,706 A * 9/1996 Gold ..... 206/296
5,573,456 A * 11/1996 Benoit et al. ..... 452/198
5,575,713 A * 11/1996 Benoit et al. ..... 452/198
5,799,425 A * 9/1998 Merser et al. ..... 40/299.01
5,810,238 A * 9/1998 Kunreuther ..... 227/71
5,987,719 A * 11/1999 Cooper ..... 24/711.1
6,220,434 B1 * 4/2001 Kubota et al. ..... 206/343
6,371,293 B2 * 4/2002 Kubota et al. ..... 206/343
6,871,436 B2 * 3/2005 Chen-Li et al. ..... 40/668
7,942,309 B2 * 5/2011 Liang ..... 229/117.25
2009/0265971 A1 * 10/2009 Cook ..... 40/633
2010/0192435 A1 * 8/2010 Miscamble et al. ..... 40/618

* cited by examiner

*Primary Examiner* — Joanne Silbermann
*Assistant Examiner* — Shin Kim
(74) *Attorney, Agent, or Firm* — Egbert Law Offices, PLLC

(57) ABSTRACT

A label tag cord made of plastic material is used as a connector between the label tag and the product, or as an independent identifier. The label tag cord includes a linearly extending and pliable cord body. First and second positioning parts are configured at opposite ends of the cord body. The preset area between the first and second positioning part form an extended block area having width and thickness larger than the cord diameter. The extended block area correspondingly defines a first surface or second surface, at least one of which forms an identifying surface. The extended surface can provide text and image layout. A display unit has a surface containing protruding or concaving parts or paste area. The text and image display unit can be a trademark, pattern, or image. The label tag cord can help to produce brand value, increase advertising effect, and enhance product value.

7 Claims, 6 Drawing Sheets

LABEL TAG CORD

CROSS-REFERENCE TO RELATED U.S. APPLICATIONS

The present application is a continuation-in-part of application Ser. No. 12/410,907, filed on Mar. 25, 2009, presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a label tag cord, and more particularly to an innovative cord with an additional identifying surface for a trademark imprint.

2. Description of Related Art Including Information Disclosed under 37 CFR 1.97 and 37 CFR 1.98

Companies in various industries need to build their own brands or reputation. For this purpose, they use their own trademarks or logos to differentiate products and to build awareness. A label tag is a common means to promote product brands and is widely used on garments, tools, and toys. A label tag is connected with the product usually through a label tag cord. There are quite a few names for a label tag cord, such as a row nail and a plastic nail. These devices present a structural improvement of the plain label tag cord.

Prior art label tag cords are very simple in structure and can be piled or rolled regularly, and therefore are suitable for massive production with high productivity. However, such prior art label tag cords also have their shortcomings. Due to the simple structure of the label tag cord, the whole structure, including the cord body and the positioning end, has a very small area, and it is difficult to identify with the naked eye its manufacturer or distributor and its brand. Therefore, it is unable to notably display its brand and value. This is regretful and is a problem.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

The label tag cord disclosed in the present invention features an innovative and unique structure of an identifying surface integrally formed on a cord body. The expanded area of the identifying surface can provide a marking place to be printed or etched with a trademark, so as to highlight and promote the brand of the product, and consequently increase the advertising effect and enhance the product value. Hence, the present invention has a good value for industrialization.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
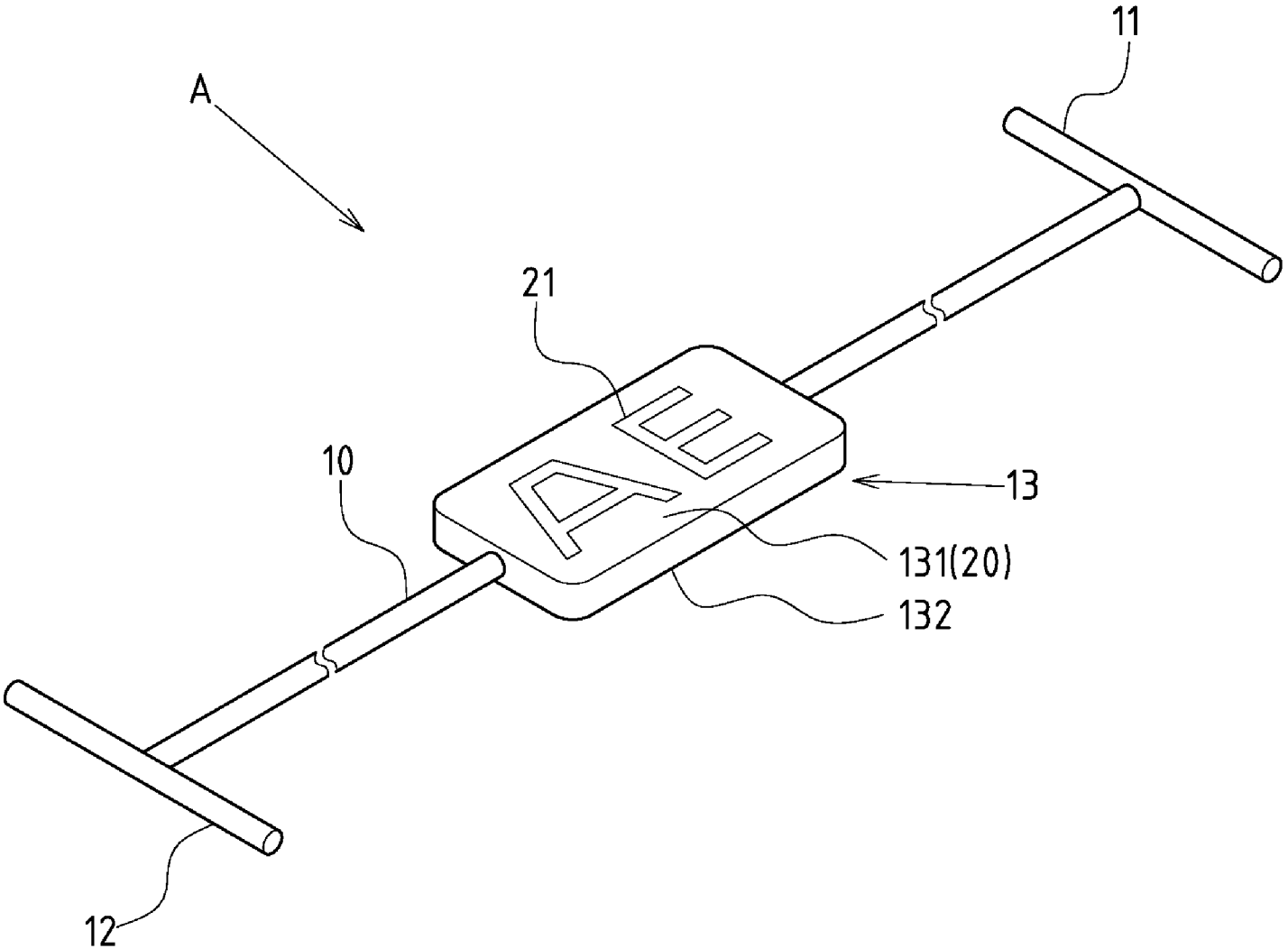
FIG. 1 shows a perspective view of a preferred embodiment of the present invention.

FIG. 1 shows a preferred embodiment of the structural improvement of label tag cord according to the present invention. While such an embodiment is for descriptive purposes only, its structure shall not in any way restrict the scope of patent application.

The label tag cord A is used as a connector between the label tag and the product, or as an independent identifier.

The label tag cord A comprises a cord body 10, linearly extending and pliable. At the two ends in the extending directions of the cord body 10, a first positioning part 11 and a second positioning part 12 are configured. The label tag cord A can be of plastic material.

An identifying surface 20 is integrally formed at a preset position between the first and second positioning part 11, 12 of the cord body 10. The identifying surface 20 is in the form of an expanded area comparing to the cord body 10. A trademark 21 can be printed or etched on the identifying surface 20 for brand promotion. Apart from this, the identifying surface 20 can also be printed with graphic designs or patterns for better visibility.

Figure 2:
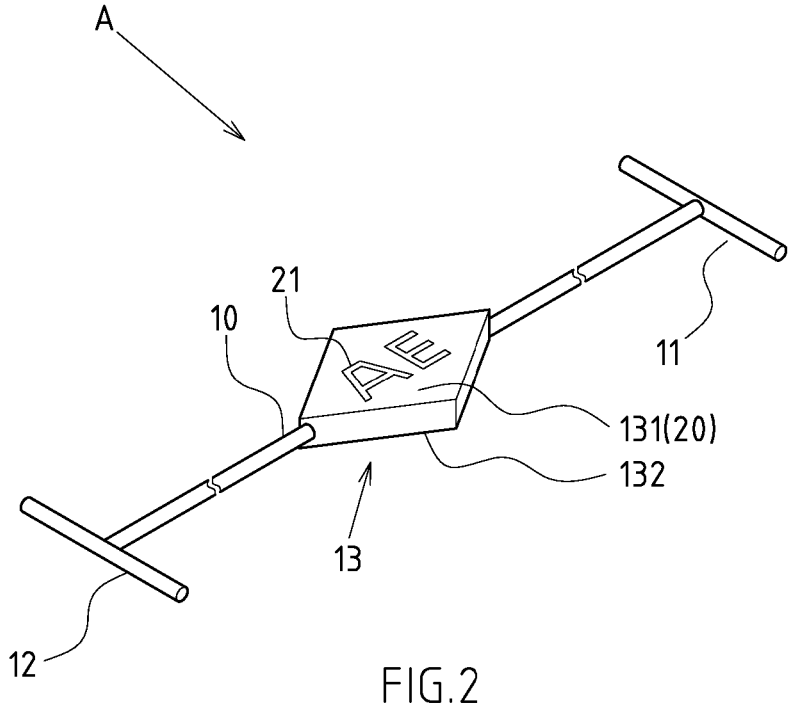
FIG. 2 shows a perspective view of another embodiment of the identifying surface of the present invention.
Figure 3:
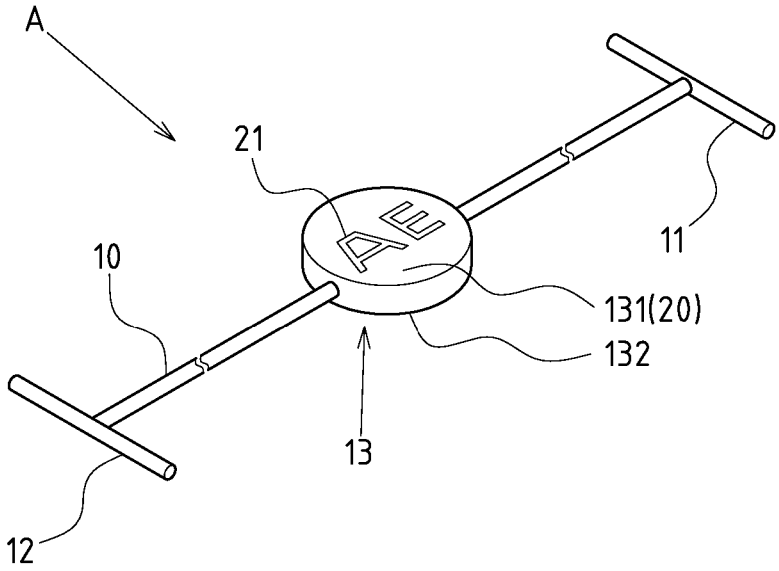
FIG. 3 shows a perspective view of another embodiment of the identifying surface of the present invention.

As shown in FIGS. 1, 2, and 3, the identifying surface 20 can be in any geometric shape, such as rectangle (as shown in FIG. 1), rhombus (as shown in FIG. 2), or circle (as shown in FIG. 3), to be selected according to the appearance of the trademark 21 for a good visual experience, and also for direct identification of the manufacturer or distributor of the product by the naked eye.

The particular forms of the label tag cord A are depicted in FIGS. 1, 2, and 3. The first positioning part 11 of the label tag cord A is configured to be in the shape of a bar vertically connected to the cord body 10, and the second positioning part 12 can be configured in the shape of a bar or strip vertically connected to the cord body 10. In the embodiment of the present invention, the first and second positioning part 11, 12 are both in the shape of a bar vertically connected to the cord body 10.

Figure 4:
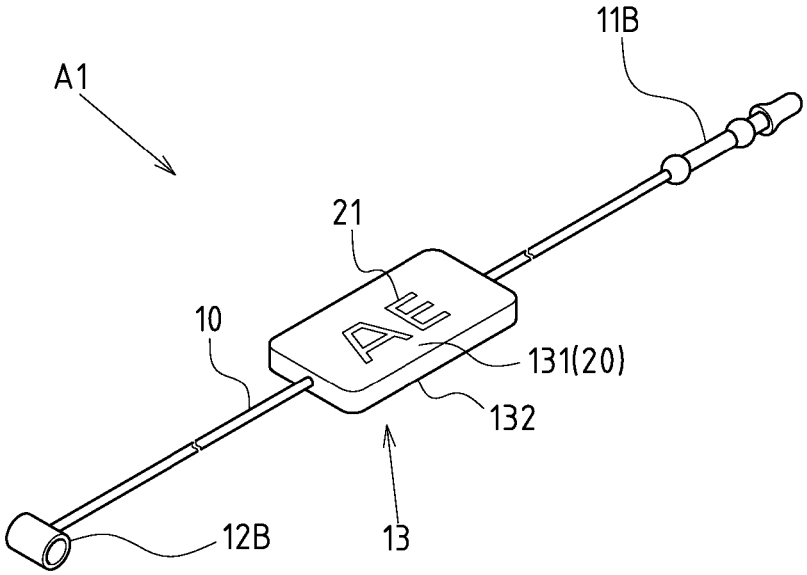
FIG. 4 shows a perspective view of another embodiment of the present invention.
Figure 5:
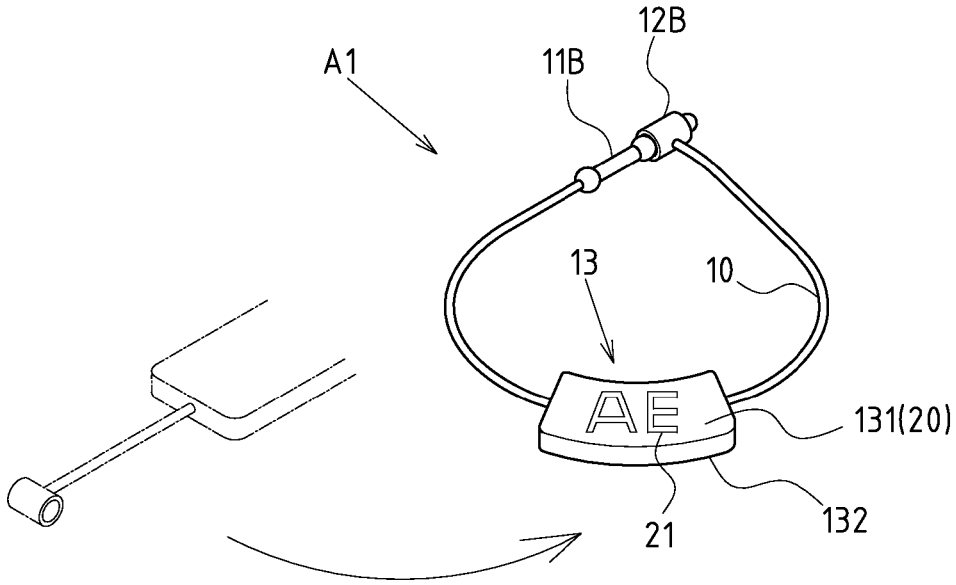
FIG. 5 shows a perspective view of an illustration of the working status of another embodiment of the present invention.

FIGS. 4 and 5 depict another embodiment of the present invention, where the first positioning part 11B can also be a male inserter, and the second positioning part 12B can be a female clasp. The female clasp is a conic and hollow clasp, while the male inserter is in the shape of a conic inserter with nodes. Based on the node of the first positioning part 11B, after inserting the first positioning part 11B into the second positioning part 12B, the male inserter can be locked in the hollow clasp, and the front end of the male inserter will protrude out of the hollow clasp. Such an assembly makes the label tag cord A1 into a ring shape.

The above structures constitute the structures of the present invention. The usage and working status of the present invention are described as follows.

Figure 6:
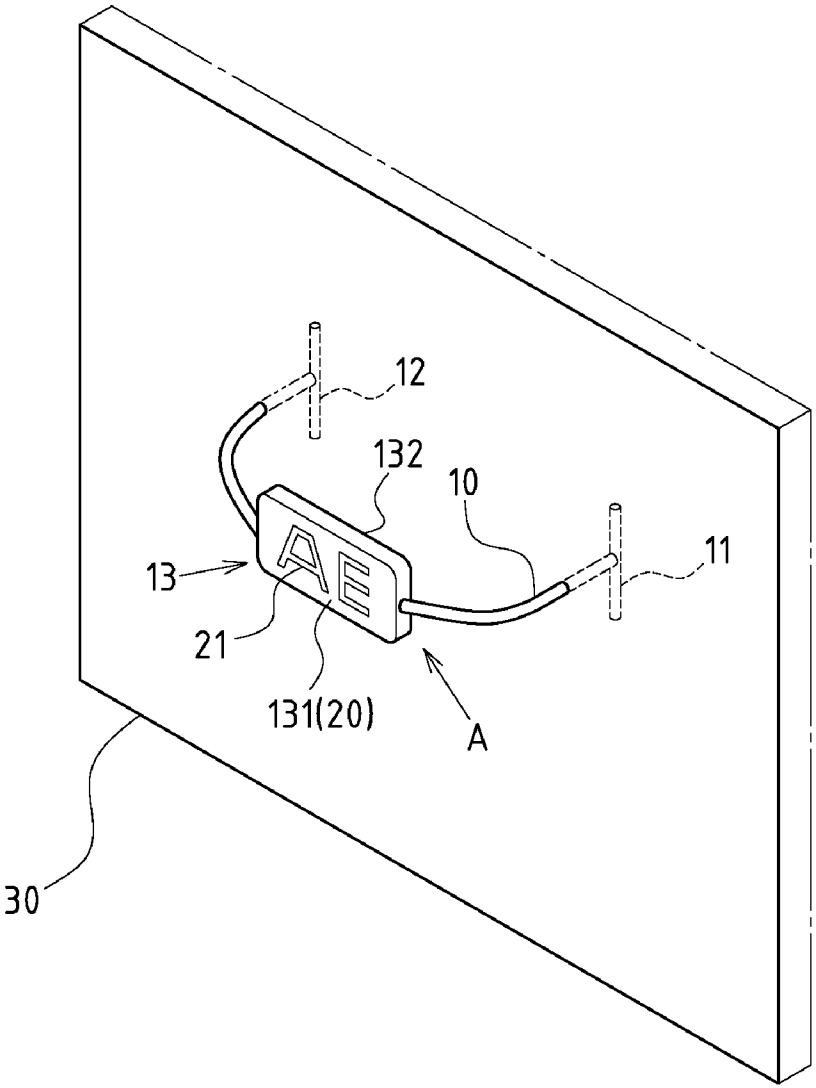
FIG. 6 shows a schematic view of the use of the embodiment of FIG. 1 of the present invention.

In the embodiment shown in FIG. 6, the first and second positioning part 11, 12 of the label tag cord A are both in the shape of a bar vertically connected to the cord body 10. The first positioning part 11 and second positioning part 12 both pierce into the same object 30 and are locked at two positions spaced with an interval, and the identifying surface 20 is displayed and positioned outside the object 30. Said object 30 is fabric or soft film that can be penetrated by a hard object.

Figure 7:
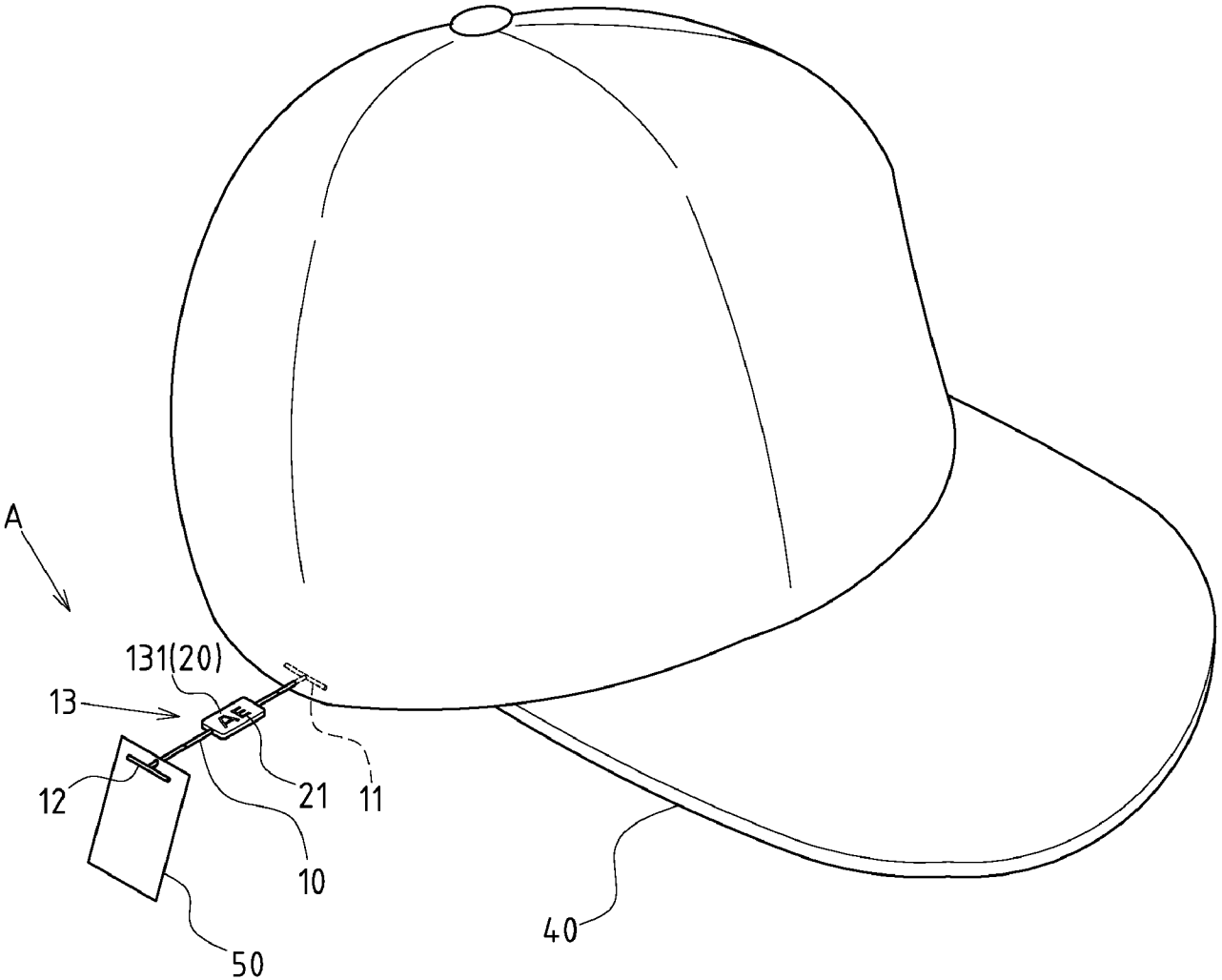
FIG. 7 shows another schematic view of the use of the embodiment of FIG. 1 of the present invention.

Referring to FIG. 7, said first positioning part 11 of the label tag cord A pierces into and is locked on the first object 40 which is fabric or soft film that can be penetrated by a hard object, and the second positioning part 12 pierces into and is locked on the second object 50 which is a label tag. In this way, the label tag cord A has double positioning functions. Through the identifying surface 20, the brand of the product can be highlighted.

Figure 8:
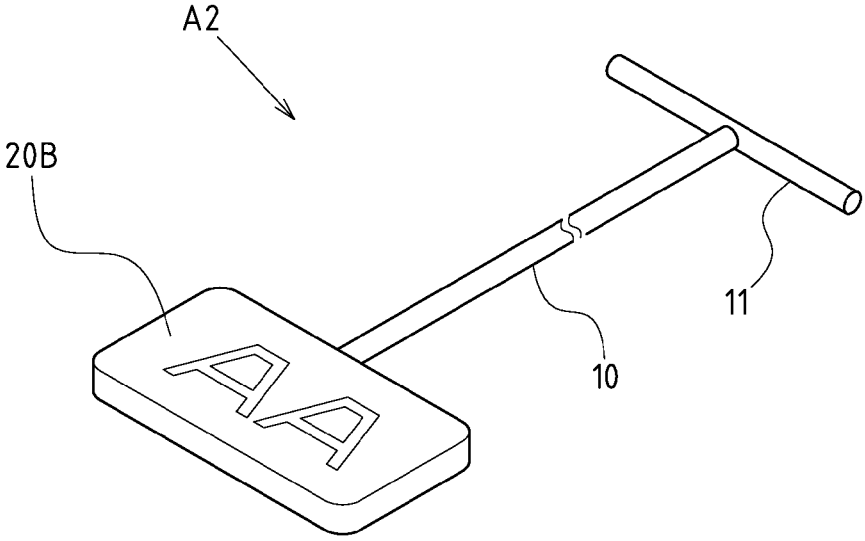
FIG. 8 shows a schematic view of another embodiment of the present invention.
Figure 9:
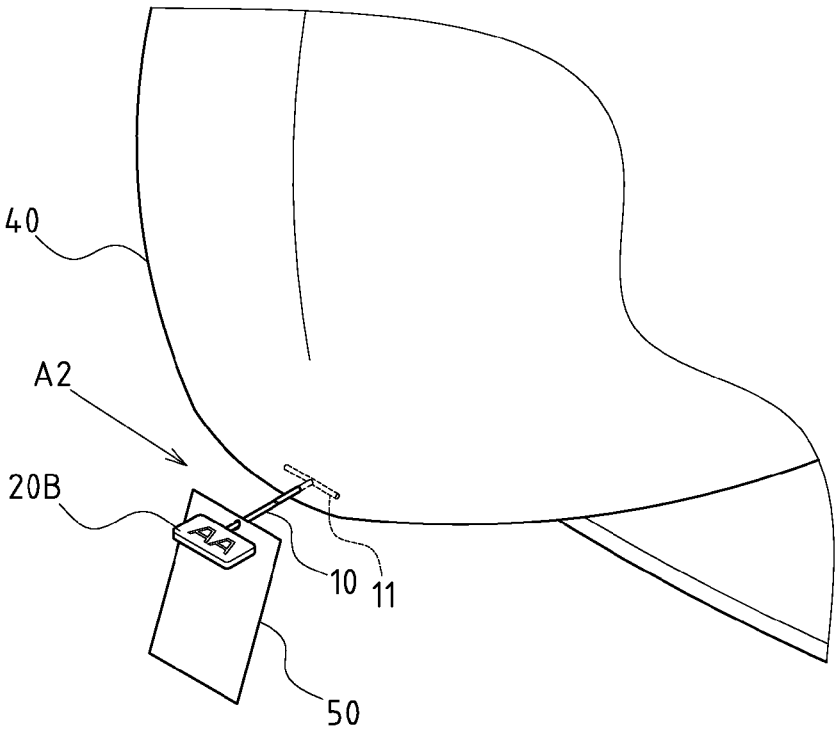
FIG. 9 shows a schematic view of the use of the embodiment of FIG. 7 of the present invention.

In the embodiment shown in FIG. 8, the label tag cord A2 is in the shape of another variation. The identifying surface 20B of the label tag cord A2 is configured on the opposite end of the first positioning part 11. The first positioning part 11 pierces into and is locked on the first object 40, while the second object 50 is blocked by the identifying surface 20B (please refer to FIG. 9). In this way, the identifying surface 20B has dual functions of brand promotion and positioning.

I claim:

1. A label tag cord article for use as a connector between a label tag and a product, the label tag cord comprising:

a cord body formed of a polymeric material, said cord body extending linearly, said cord body being pliable, said cord body having a first positioning part at one end thereof and a second positioning part formed at an opposite end thereof, said cord body having a cross-sectional diameter;

an extended block area formed on said cord body in a location between said first positioning part and said second positioning part, said block area having a width dimension and a thickness dimension larger than said cross-sectional diameter of said cord body, said block area having a planar first surface on one side thereof and a planar second surface on an opposite side thereof;

an indicia formed on at least one of said first and second surfaces of said block area, said indica protruding outwardly or indented inwardly of the surface, said indicia being text or an image; and an object through which said cord body extends in a pair of separate locations, said first positioning part and said second positioning part residing on one side of said object, said block area residing on an opposite side of said object such that said indicia is displayed outside of the object.

2. The label tag article of claim 1, said block area having a shape selected from the group consisting of a rectangle, a circle, a rhombus, and a polygon.

3. The label tag article of claim 1, said first positioning part being a bar extending transversely to said cord body.

4. The label tag article of claim 1, said second positioning part being a bar extending transversely to said cord body.

5. The label tag article of claim 1, said first positioning part being a female clasp, said second positioning part being a male inserter extending in longitudinal alignment with said cord body, said male inserter being insertable into said female clasp so as to lock said male inserter into said female clasp.

6. The label tag article of claim 1, said object being a fabric material.

7. The label tag article of claim 1, said object being a film material.

* * * * *